US008256224B2

(12) United States Patent
Garry et al.

(10) Patent No.: US 8,256,224 B2
(45) Date of Patent: Sep. 4, 2012

(54) COMBUSTION APPARATUS

(75) Inventors: Ian Murray Garry, Leicestershire (GB); Michael Lawrence Carlisle, Derby (GB); Daniel Clark, Derby (GB); Carl Lee Barcock, Derby (GB)

(73) Assignee: Rolls-Royce PLC (GB)

( * ) Notice: Subject to any disclaimer, the term of this patent is extended or adjusted under 35 U.S.C. 154(b) by 796 days.

(21) Appl. No.: 12/360,993

(22) Filed: Jan. 28, 2009

(65) Prior Publication Data

US 2009/0193813 A1 Aug. 6, 2009

(30) Foreign Application Priority Data

Feb. 1, 2008 (GB) ..... 0801839.2

(51) Int. Cl.
*F02G 3/00* (2006.01)

(52) U.S. Cl. ..... 60/753; 60/752; 60/796

(58) Field of Classification Search ..... 60/752, 60/753, 754, 755, 756, 757, 758, 759, 760, 60/796, 800
See application file for complete search history.

(56) References Cited

U.S. PATENT DOCUMENTS

| | | | | |
|---|---|---|---|---|
| 2,617,255 | A | 11/1952 | Niehus | |
| 2,916,878 | A | 12/1959 | Wirt | |
| 2,933,895 | A | 4/1960 | Cheeseman | |
| 3,295,280 | A | 1/1967 | Kettner | |
| 4,030,875 | A * | 6/1977 | Grondahl et al. | 60/753 |
| 4,315,405 | A | 2/1982 | Picock et al. | |
| 4,652,476 | A * | 3/1987 | Kromrey | 428/34.1 |
| 5,000,005 | A | 3/1991 | Kwan et al. | |
| 5,050,385 | A * | 9/1991 | Hirose et al. | 60/757 |
| 5,137,586 | A | 8/1992 | Klink | |
| 5,331,816 | A | 7/1994 | Able et al. | |
| 5,341,769 | A | 8/1994 | Ueno et al. | |
| 5,405,261 | A | 4/1995 | Scraggs et al. | |
| 5,449,422 | A | 9/1995 | Pflanz et al. | |
| 5,553,455 | A | 9/1996 | Craig et al. | |
| 5,577,379 | A | 11/1996 | Johnson | |
| 5,709,919 | A * | 1/1998 | Kranzmann et al. | 428/67 |
| 5,782,294 | A * | 7/1998 | Froemming et al. | 165/168 |
| 5,799,491 | A | 9/1998 | Bell et al. | |
| 5,957,067 | A | 9/1999 | Dobbeling et al. | |
| 6,050,081 | A | 4/2000 | Jansen et al. | |
| 6,174,389 | B1 | 1/2001 | Mann | |
| 6,182,442 | B1 | 2/2001 | Schmidt et al. | |
| 6,199,371 | B1 | 3/2001 | Brewer et al. | |
| 6,351,949 | B1 | 3/2002 | Rice et al. | |
| 6,470,685 | B2 | 10/2002 | Pidcock et al. | |
| 6,770,325 | B2 * | 8/2004 | Troczynski et al. | 427/376.2 |
| 6,901,757 | B2 | 6/2005 | Gerendas | |
| 6,931,831 | B2 | 8/2005 | Jansen | |
| 7,024,862 | B2 | 4/2006 | Miyake et al. | |
| 2002/0184892 | A1 | 12/2002 | Calvez et al. | |
| 2003/0056516 | A1 | 3/2003 | Hadder | |

(Continued)

FOREIGN PATENT DOCUMENTS

DE 10136196 A1 2/2003

(Continued)

*Primary Examiner* — William H Rodriguez
*Assistant Examiner* — Michael B Mantyla
(74) *Attorney, Agent, or Firm* — McCormick, Paulding & Huber LLP

(57) ABSTRACT

A wall element for a combustion space, the wall element comprising a ceramic body, a support within the body, and attachment means extending from the support and protruding from the body for securing the ceramic body to a combustion space wall.

13 Claims, 5 Drawing Sheets

U.S. PATENT DOCUMENTS

| | | | | |
|---|---|---|---|---|
| 2003/0079475 | A1* | 5/2003 | Schmahl et al. | 60/752 |
| 2004/0110041 | A1 | 6/2004 | Merrill et al. | |
| 2004/0118127 | A1 | 6/2004 | Mitchell et al. | |
| 2005/0034399 | A1 | 2/2005 | Pidcock et al. | |
| 2005/0238859 | A1 | 10/2005 | Uchimaru et al. | |
| 2006/0242914 | A1 | 11/2006 | Stephansky et al. | |
| 2007/0028592 | A1* | 2/2007 | Grote et al. | 60/39.37 |
| 2007/0028620 | A1 | 2/2007 | McMasters et al. | |
| 2007/0107710 | A1 | 5/2007 | De Sousa et al. | |
| 2007/0234730 | A1 | 10/2007 | Markham et al. | |
| 2007/0246149 | A1* | 10/2007 | Millard et al. | 156/89.11 |
| 2007/0289307 | A1* | 12/2007 | Grote et al. | 60/753 |
| 2008/0099465 | A1 | 5/2008 | Myers et al. | |

FOREIGN PATENT DOCUMENTS

| | | | |
|---|---|---|---|
| EP | 1734136 | | 12/2006 |
| EP | 1734136 | A2 | 12/2006 |
| EP | 1741891 | A1 | 1/2007 |
| GB | 1503921 | | 3/1978 |
| GB | 2148949 | A | 10/1984 |
| GB | 2353589 | A | 2/2001 |
| GB | 2361304 | A | 10/2001 |
| JP | 8021687 | A | 7/1994 |

* cited by examiner

COMBUSTION APPARATUS

CROSS REFERENCE TO RELATED APPLICATION

This application is entitled to the benefit of British Patent Application No. GB 0801839.2, filed on Feb. 1, 2008.

FIELD OF THE INVENTION

This invention relates to improvements to a combustor of a gas turbine engine and in particular to an arrangement of heat resistant tiles of a double wall of a combustor.

BACKGROUND OF THE INVENTION

In a double walled combustor of a gas turbine engine it is known to provide an inner wall which comprises heat resistant tiles with pedestals, which extend toward the outer wall thereby improving heat removal by a cooling air flow between the walls.

Tiles are typically formed from high temperature resistant nickel alloys which are secured to the outer wall by studs integral to the tile, washers and nuts.

Combustors are required to operate at even higher temperatures to increase efficiency of the engine. However, in order to reduce emissions from the engine, more and more of the air flow through the engine is required to be used in the combustion process leaving less air available for use as a coolant of the combustor walls.

It is desirable to use ceramic technology which can resist higher temperatures than the high temperature resistant nickel alloys. However, these ceramics are brittle in structure and are not suitable to be secured in position using the current practice.

In known ceramic liners, such as U.S. Pat. No. 5,553,455 and U.S. Pat. No. 5,957,067, the tiles making up the liner are relatively small and are generally fastened to the outer wall of the combustor by a single pin or attachment feature. In U.S. Pat. No. 5,957,087 a ceramic pin extends through an aperture in the ceramic tile and through a corresponding aperture in the metallic combustor wall and is secured by an expansion resistant fastening. In U.S. Pat. No. 5,553,455 a ceramic tile is provided with a centrally arranged integral ceramic projection that is inserted through and secured by an aperture in a glass ceramic composite support plate.

SUMMARY OF THE INVENTION

It is an object of the present invention to seek to provide an improved wall for a combustor and improved tiles for the wall.

According to a first aspect of the invention there is provided a gas turbine combustor wall element for attaching to an outer wall of a gas turbine combustor, the wall element includes a ceramic body for defining part of an inner wall of the gas turbine combustor attachment mechanism protruding from the body for securing the ceramic body to the combustor wall. The wall element is characterised in that the ceramic body contains a support which is joined to the attachment mechanism at a join location, wherein the support has one or more ligaments which extend within the ceramic body from the join location.

Preferably the ligaments follow a serpentine path which mitigates stresses caused by the difference in the thermal expansion coefficient of the support and ceramic body when the wall element is heated in use.

Preferably there are two or more attachment mechanism protruding from the body.

Preferably the attachment mechanism is joined to a common support at respective join locations.

Preferably the respective join locations are connected by a ligament.

Possibly a plurality of ligaments radiate from the join location.

The support and attachment means may be joined by a weld.

The support is preferably metallic and possibly a nickel based alloy.

Preferably the ceramic body comprises alumina which is possibly formed by firing alumina fibres in an alumina slurry.

The attachment mechanism may comprise a threaded fastener and possibly the threaded fastener is a threaded shank.

The wall element may be incorporated into a combustor which may be used in a gas turbine engine. There may be an air gap between the ceramic body and the combustion space wall and the wall element may be secured to a combustor outer wall by a fastener.

DETAILED DESCRIPTION OF THE PREFERRED EMBODIMENTS

Figure 1:
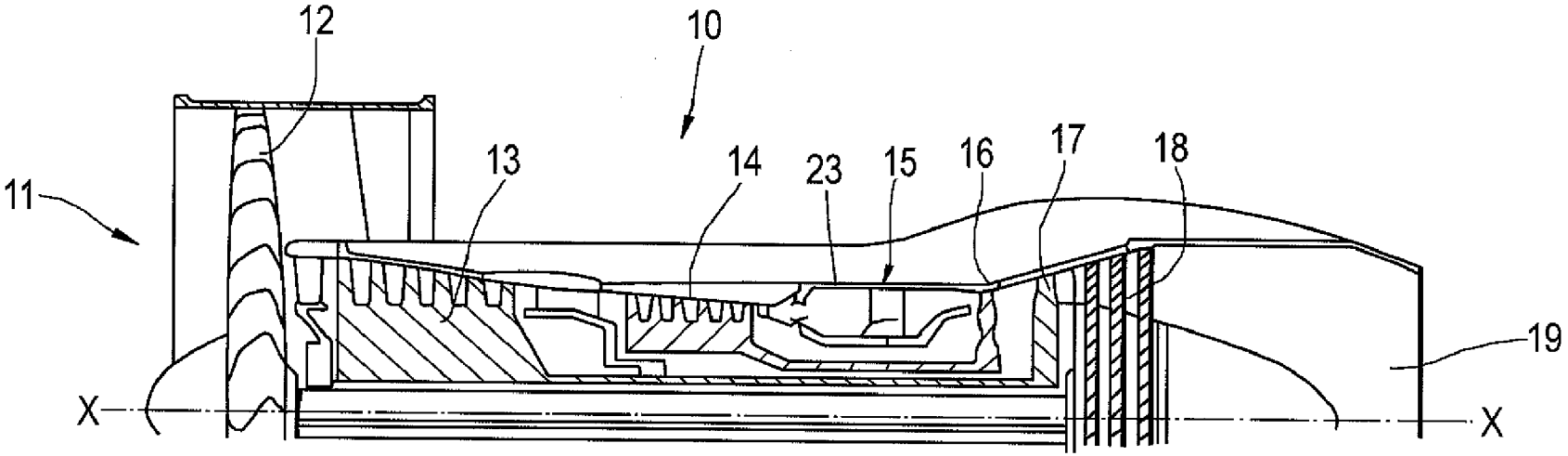
FIG. 1 is a sectional side view of a gas turbine engine incorporating a combustor in accordance with the present invention.

With reference to FIG. 1, a ducted fan gas turbine engine generally indicated at 10 has a principal axis X-X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19.

The gas turbine engine 10 works in the conventional manner so that air entering the intake 11 is accelerated by the fan 12 to produce two air flows, a first air flow into the intermediate pressure compressor 13 and a second air flow which provides propulsive thrust. The intermediate pressure compressor 13 compresses the airflow directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive, the high, intermediate and low-pressure turbine 16, 17 and 18 before being exhausted through the nozzle 19 to provide additional propulsive thrust. The high, intermediate and low-pressure turbines 16, 17 and 18 respectively drive the high and intermediate pressure compressors 14 and 13 and the fan 12 by suitable interconnecting shafts (not referenced).

Figure 2:
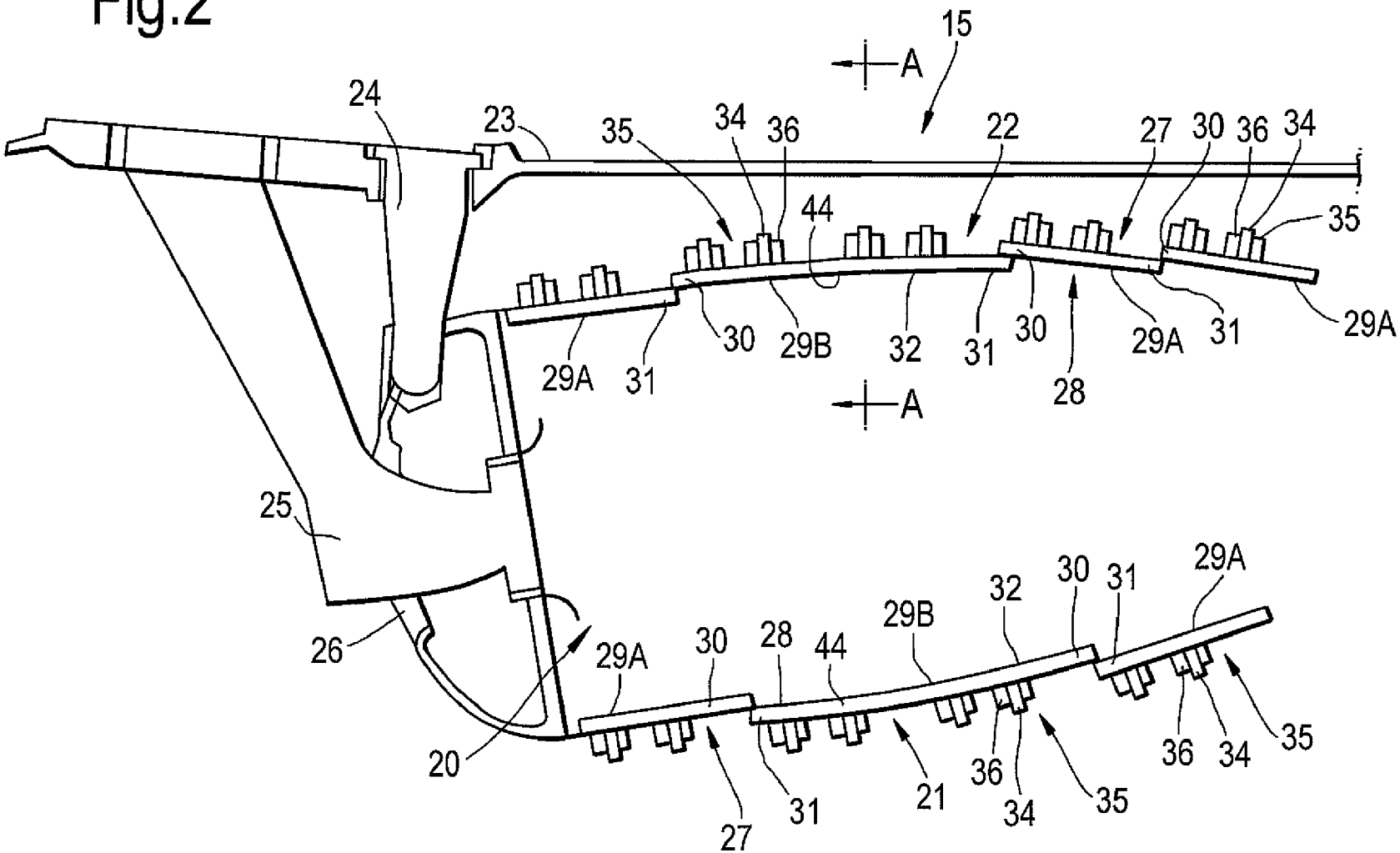
FIG. 2 shows a sectional side view of part of a combustor of the engine shown in FIG. 1.

Referring to FIG. 2, the combustor 15 is constituted by an annular combustion chamber 20 having radially inner and outer wall structures 21 and 22 respectively. The combustor 15 is secured to a wall 23 by a plurality of pins 24 (only one of which is shown). Fuel is directed into the chamber 20 through a number of fuel nozzles 25 located at an upstream end 26 of the chamber 20. The fuel nozzles 25 are circumferentially spaced around the engine 10 and serve to spray fuel into air derived from the high-pressure compressor 14. The resultant fuel/air mixture is then combusted within the chamber 20.

The combustion process takes place within the chamber 20 and naturally generates a large amount of heat. It is necessary, therefore, to arrange that the inner and outer wall structures 21 and 22 are capable of withstanding the heat.

The radially inner and outer wall structures 21 and 22 each comprise an outer wall 27 and an inner wall 28. The inner wall 28 is made up of a plurality of discrete wall elements in the form of tiles 29A and 29B.

Each of the tiles 29A, 29B has circumferentially extending edges 30 and 31, and the tiles are positioned adjacent each other, such that the edges 30 and 31 of adjacent tiles 29A, 29B overlap each other. Alternatively, the edges 30, 31 of adjacent tiles can abut each other. Each tile 29A, 29B comprises a base portion 32 which is spaced from the outer wall 27 to define therebetween a space for the flow of cooling fluid in the form of cooling air as will be explained below. Heat removal features in the form of pedestals can be provided on the base portion 32 and extend into the space 44 towards the outer wall 27.

During a normal operating cycle of the engine 10 the combustor 20 is subject to varying amounts of combustion heat. This causes the tiles 29A and 29B to thermally expand relative to the outer walls 27. Where the tile is of a ceramic material it is not possible to use the ceramic material to directly fix the tile to the outer wall as the ceramic is too brittle.

Figure 3:
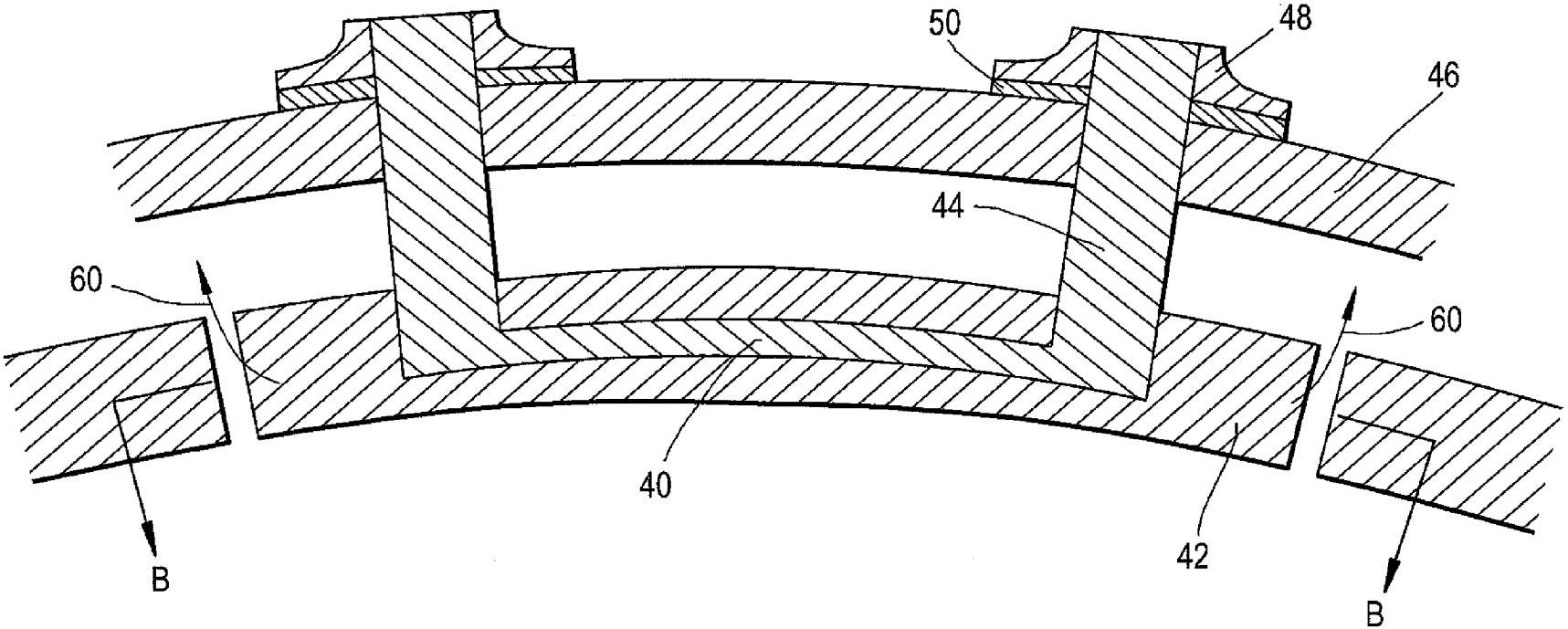
FIG. 3 is a sectional side view A-A on FIG. 2 showing part of a radially outer wall structure of a combustor double wall element of a first embodiment of the present invention.
Figure 4:
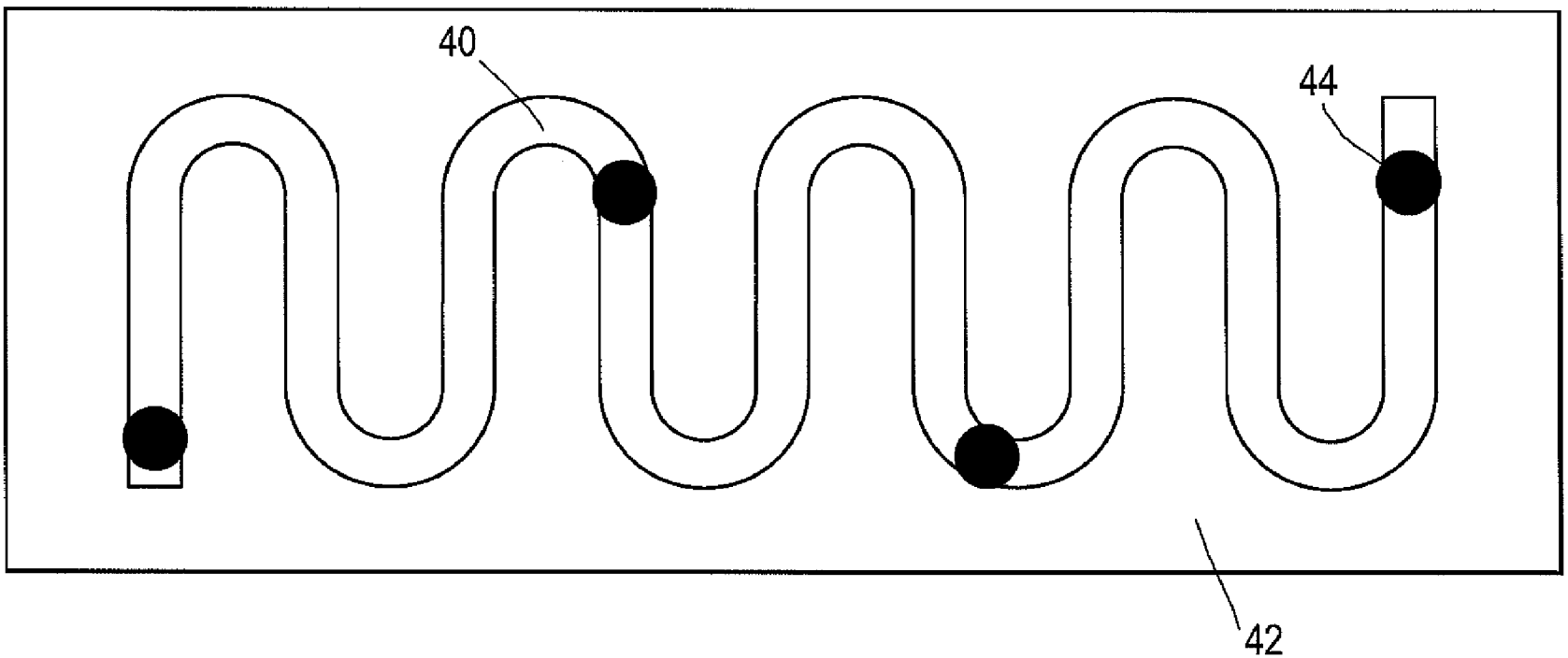
FIG. 4 is a sectional side view B-B on FIG. 3 showing part of a radially outer wall of a combustor double wall element of a second embodiment of the present invention.

Accordingly, an internal structure is used to both re-enforce the tile and to provide mechanical fixing attachments. In the preferred embodiment as shown in FIGS. 3 and 4 the internal structure is in the form of a sheet metal cut profile 40 having a serpentine form that limits the effect of differential thermal expansion rates between the ceramic of the tile and the internal structure.

The tile is formed of Alumina with an internal support of a high temperature nickel based alloy such as C263. This alloy is commercially available under the tradenames Nicrofer 5120, Hastelloy C263 and Nimonic 263. A C263 alloy has a typical composition of (by wt %): Cr 19.0-21.0, Mn up to 0.6, Si up to 0.4; C 0.04-0.08, Al 0.3-0.6, Ag up to 0.0005, Cu up to 0.2, Mo 5.6-6.1, Co 19.0-21.0, Ti 1.9-2.4, Pb up to 0.002, Zr up to 0.02, P up to 0.015, Fe up to 0.7, S up to 0.007, B up to 0.005. The balance is nickel and the total amount of Al plus Ti in the composition should be 2.4-2.8. It will be appreciated that other alloys will be suitable. C263 has a thermal coefficient of expansion is $13.4\times10^{-6}$ m/m·K.

The tile is around 100 mm by 80 mm in plan and has a curvature to fit a combustor wall of approximately 450 mm diameter. The tile has a thickness of around 5 mm. It will be appreciated that these figures are exemplary and another other size of tile may be used.

To manufacture the tile a sheet of C263 with a thickness of around 1 mm is cut or stamped to the desired form and a number of attachment features welded thereon. The attachment features have a screw thread and are arranged to pass through apertures in the outer wall 46 of the combustor. A nut 48 and washer 50 are screwed onto the attachment features to secure the tile to the combustor wall. In the embodiment described the combustor wall is formed of a nickel alloy of the same composition as that of the tile internal support.

A series of layers formed of alumina fibres are applied around the support structure and alumina slurry used to bind the layers to the support. The alumina fibres and slurry are then fired in a furnace before being machined to improve the surface finish or to form cooling apertures to allow the passage of air from a plenum into the combustion chamber.

The tile is installed within the combustor by inserting attachment features through the outer combustor wall and applying a nut onto the threaded end. A resilient washer or spring element may be provided to provide a damping effect and to aid spacing alignment between the tile and the outer wall.

As the temperature in the combustor increases the tile, internal support and outer wall all expand by thermal expansion at different rates. The thermal coefficient of expansion of the internal tile support is greater than that of the ceramic but as mentioned above is the same as or comparable to that of the combustor outer wall.

To accommodate the different expansion rates of the ceramic and its internal support and to prevent the internal support detaching from the ceramic over a period of time the support flexes in union with any tile growth or movement. The internal support is provided with relieving features which, in this embodiment, are provided by the serpentine ligaments between the joins where the attachment features are secured to the support.

As shown in FIG. 3, each tile is bowed such that when multiple tiles are secured to the outer wall of the combustor the tiles uniformly curve around the wall. As the temperature in the combustor increases the tiles tend to try and straighten to cause potential rotation in the direction of arrows 60. Towards the edges of the tile the forces generated by such movements can create cracking in the ceramic material 42 which can be exacerbated by the use of dissimilar materials such as metal alloys in the tiles.

The relieving features in the tile internal support structure reduces the stress build up by allowing the metal support to flex.

The above embodiment enables the manufacture ceramic tiles that locate to a combustor at more than one attachment point. The internal support also allows of larger ceramic tiles connecting to a combustor through a single attachment point. Alternative embodiments are exemplified in FIGS. 5 and 6.

Figure 5:
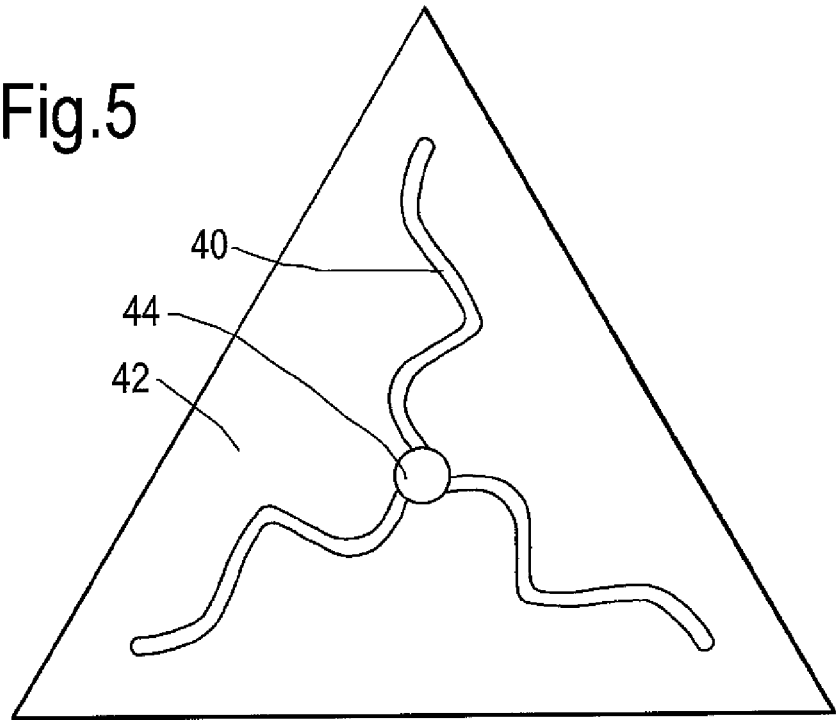
FIG. 5 is a sectional side view of a further embodiment of a wall tile in accordance with the invention.
Figure 6:
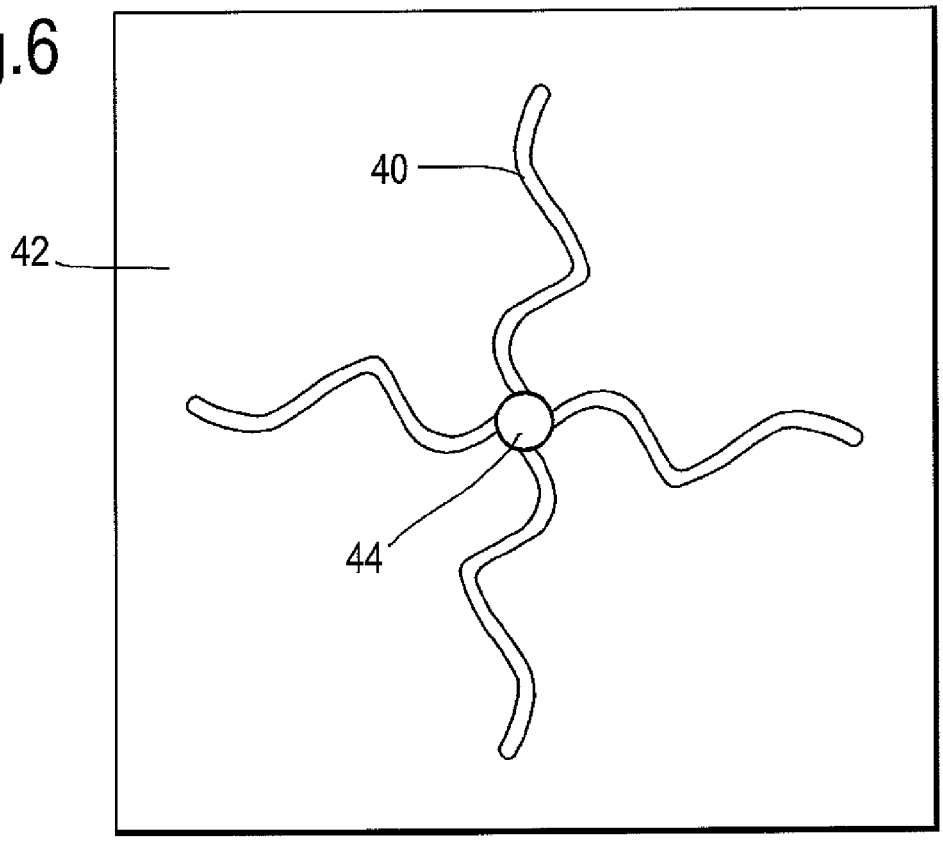
FIG. 6 is a sectional side view of a further embodiment of a wall tile in accordance with the invention.

In FIGS. 5 and 6 shaped tiles are provided with a single attachment point. From the attachment points a series of internal structures radiate outwards towards the edge of the tiles. As in the embodiment described with reference to FIGS. 3 and 4 the structures are formed by cutting or stamping an appropriate metal around which the ceramic is formed.

The shape of the support permits flexure in union with any tile growth or movement.

What is claimed is:

1. A gas turbine combustor wall element for attaching to an outer wall of a gas turbine combustor, the wall element comprising:

a ceramic body for defining part of an inner wall of the gas turbine combustor; and a support contained by the ceramic body, said support having one or more serpentine ligaments extending from a location within the ceramic body, and having an attachment element joined to the serpentine ligaments and extending from the location in a direction perpendicular to the serpentine ligaments and protruding outward from the ceramic body for securing the ceramic body to the outer wall.

2. A gas turbine combustor wall element as claimed in claim 1, the wall element comprising:

a further location on at least one of the serpentine ligaments and a further attachment element extending from the further location in a direction perpendicular to the serpentine ligament and protruding from the ceramic body for securing the ceramic body to the outer wall.

3. A gas turbine combustor wall element as claimed in claim 1, wherein the support is metallic.

4. A gas turbine combustor wall element as claimed in claim 3, wherein the support is a nickel based alloy.

5. A gas turbine combustor wall element as claimed in claim 1, wherein the support has a plurality of serpentine ligaments radiating from the join location.

6. A gas turbine combustor wall element as claimed in claim 1, wherein the ceramic body comprises alumina.

7. A gas turbine combustor wall element as claimed in claim 6, wherein the alumina is formed by firing alumina fibres in an alumina slurry.

8. A gas turbine combustor wall element as claimed in claim 1, wherein the attachment element comprises a threaded fastener.

9. A gas turbine combustor wall element as claimed in claim 8, wherein the threaded fastener is a threaded shank.

10. A combustor for a gas turbine, said combustor comprising a wall element as claimed in claim 1, said wall element secured by its attachment element to a combustion space wall.

11. A combustor for a gas turbine engine as claimed in claim 10, wherein the attachment element extends through the combustion space wall and is secured thereto by a fastener.

12. A combustor for a gas turbine engine as claimed in claim 10, wherein an air gap is provided between the ceramic body and the combustion space wall.

13. A turbine engine comprising:

a turbine;

a compressor connected via a shaft to the turbine;

a main fuel supply line for supplying fuel; and a combustor positioned for receiving the fuel and for releasing hot expanding gases to the turbine, said combustor including a gas turbine combustor wall element for attaching to an outer wall of a gas turbine combustor, the wall element comprising:

a ceramic body for defining part of an inner wall of the gas turbine combustor; and a support contained by the ceramic body, said support having one or more serpentine ligaments extending from a location within the ceramic body, and having an attachment element joined to the serpentine ligaments and extending from the location in a direction perpendicular to the serpentine ligaments and protruding outward from the ceramic body for securing the ceramic body to the outer wall.

* * * * *